US008523481B2

(12) United States Patent
Schimp

(10) Patent No.: US 8,523,481 B2
(45) **Date of Patent: *Sep. 3, 2013**

(54) METHOD AND APPARATUS FOR RECOVERING, TRANSPORTING, AND USING METHANE GAS

(75) Inventor: Christopher E. Schimp, Eldorado, IL (US)

(73) Assignee: Compressed Energy Systems LLC, Eldorado, IL (US)

( * ) Notice: Subject to any disclaimer, the term of this patent is extended or adjusted under 35 U.S.C. 154(b) by 427 days.

This patent is subject to a terminal disclaimer.

(21) Appl. No.: 12/771,573

(22) Filed: Apr. 30, 2010

(65) Prior Publication Data

US 2010/0266340 A1 Oct. 21, 2010

Related U.S. Application Data

(63) Continuation-in-part of application No. 12/498,849, filed on Jul. 7, 2009, now Pat. No. 7,766,578, which is a continuation of application No. 11/726,235, filed on Mar. 21, 2007, now Pat. No. 7,571,763.

(60) Provisional application No. 60/784,412, filed on Mar. 21, 2006.

(51) Int. Cl.
*F17C 13/00* (2006.01)

(52) U.S. Cl.
USPC ..... 405/53

(58) Field of Classification Search
USPC ..... 405/52, 53
See application file for complete search history.

(56) References Cited

U.S. PATENT DOCUMENTS

| | | | | |
|---|---|---|---|---|
| 3,277,654 | A | 10/1966 | Shiver | |
| 3,331,206 | A | 7/1967 | Osborne | |
| 3,807,181 | A | 4/1974 | Kuhne | |
| 4,085,800 | A | 4/1978 | Engle et al. | |
| 4,159,037 | A | 6/1979 | Vamon et al. | |
| 4,161,047 | A | 7/1979 | Riley | |
| 4,300,632 | A | 11/1981 | Wiberger et al. | |
| 4,380,265 | A | 4/1983 | Mohaupt | |
| 4,417,829 | A | 11/1983 | Berezoutzky | |
| 4,474,053 | A | 10/1984 | Butler | |
| 4,741,395 | A | 5/1988 | Reed et al. | |
| 5,207,530 | A * | 5/1993 | Brooks et al. | 405/55 |
| 5,385,176 | A * | 1/1995 | Price | 141/1 |
| 5,607,016 | A | 3/1997 | Butler | |
| 5,921,321 | A | 7/1999 | Sepich | |
| 5,942,469 | A | 8/1999 | Juprasert et al. | |
| 6,108,967 | A | 8/2000 | Erickson | |
| 6,176,317 | B1 | 1/2001 | Sepich | |
| 6,209,350 | B1 | 4/2001 | Kimble | |
| 6,554,388 | B1 | 4/2003 | Drake et al. | |
| 6,808,693 | B2 | 10/2004 | Arnaud et al. | |
| 6,869,147 | B2 | 3/2005 | Drake et al. | |
| 7,056,062 | B2 | 6/2006 | Takeuchi et al. | |
| 7,464,557 | B2 | 12/2008 | Vandor et al. | |
| 7,571,763 | B2 * | 8/2009 | Schimp | 166/53 |

(Continued)

*Primary Examiner* — John Kreck
(74) *Attorney, Agent, or Firm* — Bryan Cave LLP

(57) ABSTRACT

Methods and systems for recovering, transporting, and using methane gas and conventional Natural Gas are disclosed. More particularly, such methods generally include the steps of (a) transferring gas from a source to a first subterranean capacitor and storing the gas in the capacitor and (b) transferring gas from the first subterranean capacitor to a second subterranean capacitor, a pipeline, an end user (such as an automobile), a gas processor, or a power plant.

20 Claims, 3 Drawing Sheets

(56) References Cited

U.S. PATENT DOCUMENTS

| | | | | |
|---|---|---|---|---|
| 7,766,578 | B2 * | 8/2010 | Schimp | 405/53 |
| 2002/0029585 | A1 | 3/2002 | Stone et al. | |
| 2004/0136784 | A1 | 7/2004 | Dahlem et al. | |
| 2005/0022416 | A1 | 2/2005 | Takeuchi et al. | |
| 2006/0048920 | A1 | 3/2006 | Heileur | |
| 2006/0120806 | A1 | 6/2006 | Leone et al. | |
| 2006/0254287 | A1 | 11/2006 | Greenberg et al. | |
| 2006/0254765 | A1 | 11/2006 | Pfeiffer et al. | |

* cited by examiner

METHOD AND APPARATUS FOR RECOVERING, TRANSPORTING, AND USING METHANE GAS

CROSS-REFERENCE TO RELATED APPLICATIONS

This Application is a continuation of U.S. application Ser. No. 11/726,235, filed Mar. 21, 2007, which claims priority to U.S. Provisional Application Ser. No. 60/784,412, filed Mar. 21, 2006.

FIELD OF THE INVENTION

The field of the invention relates to methods and systems for recovering, transporting, and using methane gas and conventional Natural Gas.

BACKGROUND OF THE INVENTION

There are several limitations and problems associated with prior art gas storage and loading systems, particularly when used to load a tanker or automobile with gas. For example, when using certain prior art storage and loading systems, it would typically take up to 24 hours to compress 300 mcf of methane gas into a tanker at a pressure of 3000 psi. Similar limitations apply to the smaller tanks used in standard natural gas-operated automobiles. The rate-of-transfer of gas into such tanks has been limited for several reasons. Specifically, if the gas is loaded too fast into the tank using the prior art methods, the gas undergoes an undesirable and extreme drop in temperature, which may cause the gas to liquefy and/or the gas loading regulator to freeze.

Accordingly, a demand exists for methods and systems that enable a quick and safe transfer of gas into a tanker or automobile. As explained further below, the present invention addresses such demand.

SUMMARY OF THE INVENTION

According to a preferred aspect of the invention, readily available commercial CNG transport trailers or tankers are utilized to carryout the methods described herein. The invention provides, however, that such tankers are not required to be left at the unloading and loading sites for long periods of time, as is the case with certain prior art methods and systems. Instead, the loading and unloading steps described herein are accomplished quickly and efficiently. As a result, as few as one tanker can be used, instead of multiple tankers, to carryout certain methods described herein, thereby providing a substantial cost advantage.

In most areas where coal mining is present, there is an abundance of unused or abandoned oil wells, and in some cases, oil wells that cover the countryside. For instance, in the southern region of the state of Illinois and in Kentucky, both of the United States, many of these wells are about 3000 feet deep with 8 inch casing that have been cemented into the ground. The formations in which they produce, or formerly produced, can be easily sealed off to keep fluids out and the gas in. Also, these wells can hold high pressures, for instance, 4,000 psi.

As a result, according to the invention, it has been found that just two wells, for instance, 8 inches in diameter by 3000 feet deep can be used as subterranean capacitors for holding twice as much compressed gas as the biggest and highest volume bulk transport tanker, at a high pressure, such as 3000 psi. With 600,000 cubic feet of gas (600 mcf) charged on site in two oil wells used as capacitors at this pressure, a tanker having a capacity of 300 mcf can be loaded with gas therefrom to this pressure very quickly, for instance, in less than half an hour.

Unused or abandoned oil wells are a liability for plugging if not operated. Many companies are willing to give them away due to plugging costs up to $5,000 per well. Thus, as an example, using oil wells as subterranean capacitors can allow a compressor to operate 24 hours for filling the capacitors, enabling a smaller compressor to be used, steady flow from the production wells, and quick loading into the transport tanker to deliver the gas to the end user. Additionally, only one transport is needed instead of three—which are typically required when using prior art systems.

Similarly, at the unloading facility, one or more subterranean capacitors can be used, which can be, for instance, one or more producing or non-producing oil wells, an unused mine, a subterranean formation, or a subterranean cylinder. As used herein, a "subterranean cylinder" refers to a subterranean structure that is similar in size, dimension, and construction to an oil well. For example, a "subterranean cylinder" may consist of a hole drilled into the ground that is surrounded by, for example, several inches of cement casing. The hole is preferably lined with a material, such as steel or any other suitable liner. The subterranean cylinder may be constructed near the site of a producing well for the purpose of extracting gas from the producing well and storing the gas in the subterranean cylinder. In other words, the invention contemplates that, in addition to abandoned oil wells, newly constructed subterranean cylinders may be positioned near producing wells for the purpose of storing gas therein. Still further, the invention provides that subterranean cylinders may be constructed and positioned at any location that would be convenient to load gas into automobiles—i.e., Natural Gas filling stations. A "producing well," as used herein, refers to any source of methane gas, Natural Gas, combinations thereof, and/or constituents thereof.

An advantage of using a subterranean capacitor according to the invention is that it will take gas quickly, but let it out slowly, which is what is typically required by end users, because the gas usage rate of the user is typically lower than what can be supplied by unloading at a rate of 300 mcf per hour.

An abandoned or unused coal mine can have a very large capacity as a capacitor and can receive gas very quickly. Multiple subterranean cylinders and/or oil wells can be manifolded together, to also allow unloading quickly. When oil wells are drilled 330 feet to 660 feet from each other, which is common, the oil wells are sufficiently close to each other, such that a high pressure pipe can be used to economically connect them together at the unloading facility.

The method of unloading and loading according to the invention reduces the number of transports used, eliminates expensive storage and utilizes an asset, i.e., an abandoned well or mine, that would otherwise be rendered worthless. This method makes a significant difference in the economics and will now allow stranded gas to be brought to market, thereby lessening dependence on foreign energy.

Compressed Gas In-Grand Capacitors Advantages

Utilizing the subterranean capacitors of the present invention, and/or unused or abandoned oil wells already in place as subterranean capacitors, to compress methane gas (or Natural Gas) up to a high pressure, for instance, 3000 psi, gives the capacitor a geothermal advantage. With the well so deep in the ground, the area or geology of the earth around the well will eventually, after several days, heat up the surrounding rock. This can be advantageous according to the invention, as the surrounding earth can therefore be used as a thermal insulator for the gas in the capacitor, to conserve the heat thereof. In contrast, if the gas was circulated through several miles of underground pipe, the geothermal action would cool the gas down. A compressor running 24 hours per day, every day, at 3000 psi would create a tremendous amount of heat, up to 200 degrees. To capture the heat is very difficult if loading every day out of surface storage, due to heat lost to the atmosphere. Insulation and/or heaters typically have to be used when the gas is unloaded into the transport. Whereas, in the capacitor of the invention, as a result of the insulating effect, the surrounding rock heats up and retains the heat even after loading a transport every day. This phenomenon is comparable to certain attributes of masonry fireplaces, wherein the stone is heated from the fire and then after the fire goes out, the stone will continue to radiate heat for some time. Therefore, the geothermal action keeps the gas stored in the capacitor at an elevated temperature, even after frequent discharging of the capacitor, for instance, every 24 hours.

Another advantage of the invention is keeping the gas at an elevated temperature during loading of a transport from the capacitor, which is done by discharging the gas capacitor. When 3000 psi is discharged initially into the empty transport at 0 psi, the pressure drop is tremendous as is the velocity of the gas flow. This creates a freezing action, such that the temperature of the gas will typically drop 1 degree Fahrenheit for every 15 psi drop in pressure. This will typically drop the temperature 200 degrees over the course of the unloading. This can cause the regulators to freeze even if they are insulated. Gas will also liquefy at 220 degrees below zero, which should also be prevented. The gas stored in a capacitor of the present invention, because the capacitor is insulated, will retain much of its heat from compression, over time, so as to still be at an elevated temperature when transferred to a tanker or automobile. As a result, when loading from one or more capacitors into an initially low pressure tanker (or tank of an automobile), the temperature drop will be from an elevated temperature, much higher than, for instance, the ambient air temperature, such that a freezing action can be avoided.

The main problem associated with gas freezing is that the gas is well-head gas that has not yet been processed. The gas capacitor is in the field to facilitate transportation from the well head to be processed. Without processing, the gas will contain moisture, which has to be removed during processing. This moisture will cause problems if the gas temperatures are well below zero degrees during loading. The geothermal capability of the gas capacitor of the invention will reduce this problem, because the cooling of the gas can be retarded or slowed by the insulating nature of the earth or the formation surrounding the capacitor or capacitors, so as not to drop in temperature as drastically. This will also facilitate unloading due to the warmer gas from the loading, as even after being transported for several hours, for instance, 1 to 2 hours, the gas in the tanker will still be warmer at unloading.

The Transport Unloading Gas Capacitor

As the gas is unloaded from the capacitor from a pressure of, for example, 3000 psi and loaded into a transport tanker (or the tank of an automobile), the gas again will get very cold. This temperature can cause freezing problems before the gas arrives at the processing plant—or is otherwise combusted in an automobile engine. Using a number of wells (or subterranean cylinders) as capacitors at the unloading site, for instance, three wells (or a formation, an unused or abandoned coal mine, or one or more subterranean cylinders), the geothermal action of the normalized temperature of the subterranean surroundings of the capacitor, for instance, about 58 degrees Fahrenheit, will advantageously warm up the gas.

Also, utilizing a well or subterranean cylinder in connection with a geological formation such as sand rock as a gas capacitor will allow the gas to load into the formation while holding pressure in the capacitor. The pressure holding saves pressure from the compression that was generated at the well sites which will eliminate the need for a compressor at the unloading site. This pressure can then be used to deliver the gas out of the gas capacitor to the gas processing plant, automobile tank, or other end user. The gas pressure can be controlled with a pressure reducing regulator from the gas capacitor to the processing plant instead of a compressor. It is anticipated that the formation portion of the capacitor will be able to take several tanker loads of gas before a portion of the gas is to be removed from the capacitor. This provides a cushion in the system which will drive the gas and/or save the pressure during discharging as long as the amount of gas discharged during, for instance, a 24 hour period is the same that is loaded into the capacitor during the same 24 hour period.

DETAILED DESCRIPTION OF THE INVENTION

Figure 1:
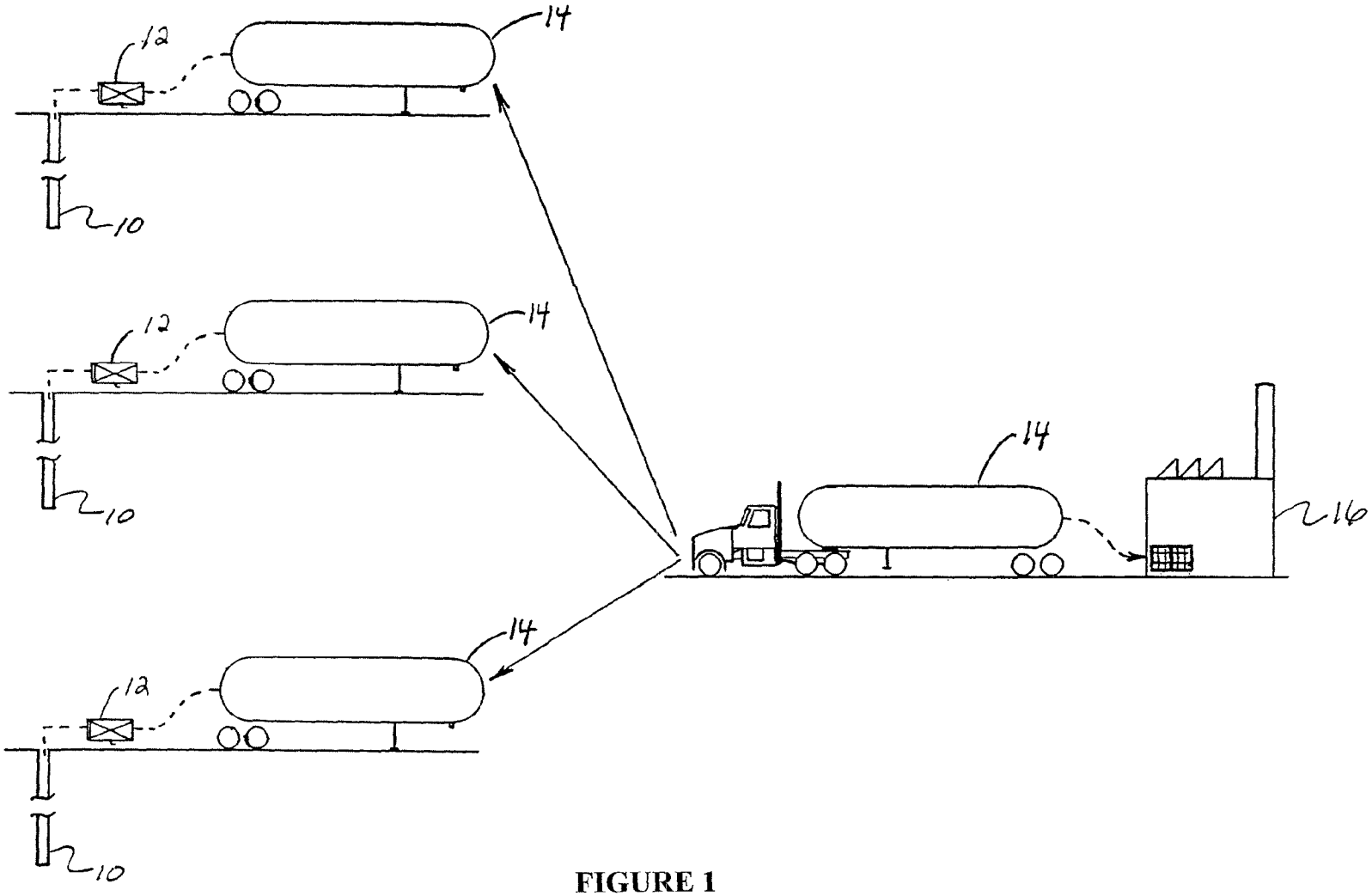
FIG. 1 is a simplified schematic diagram of a prior art method and apparatus for recovering and transporting methane gas.

Referring now to the drawings, wherein like numerals refer to like parts, FIG. 1 illustrates well-known prior art apparatus and methods for recovering and transporting methane gas from a source, such as one or more gas wells in association with one or more underlying coal mines, and transporting the methane gas to an end user, such as, but not limited to, a power generation facility, pipeline, or the like. Essentially, at one or more gas wells 10, conventional, well known apparatus for recovering methane gas therefrom will typically include a compressor 12 in connection with the well 10 using a suitable pipe network (shown by the dotted lines) for receiving or drawing methane gas from a well 10 and compressing the gas into a suitable transport tanker 14. Such tankers 14 are also of conventional, well known construction and operation and can typically hold gas compressed up to about 3000 psi. At the typical rate at which the methane gas can be extracted and compressed, it will typically take up to 24 hours to compress 300 mcf of methane gas into a tanker 14 at that pressure, which is the typical capacity of a tanker. At an end user, such as a co-firing power plant 16, a typical 300 mcf tanker can be unloaded in about 8 hours, as denoted by the dotted arrow. As a result, for three gas wells 10, it is common to utilize 4 tankers 14, for providing a continuous supply of methane gas to an end-user, such as a co-firing power plant 16. This can be quite expensive capital wise, as tankers, such as the tankers 14, can cost several hundred thousand dollars each.

At the loading end, typical tankers 14 must be loaded relatively slowly, for instance, over a 24 hour period, because the compressing of the gas results in heating of the gas, which can cause dangerous overheating of the tanker 14, if filled too quickly. At the end user site, when the gas is unloaded, if done too quickly, the unloading apparatus, as well as regions of the tanker 14, can be subjected to freezing, which can also be a dangerous and/or create a damaging condition. As an alternative, it has been contemplated to utilize above ground gas storage tanks in connection with one or more gas wells, such as wells 10 illustrated. However, above ground storage tanks still must be filled slowly, and represent a significant capital expense. As another factor, at the loading end, if the ambient temperature is hot, and/or the tanker 14 is exposed to significant sun light, the ability of the tanker 14 to dissipate heat can be reduced, thereby requiring slower loading. Similarly, at the unloading end, if ambient temperatures are low, and/or it is dark or cloudy, unloading speed may have to be reduced, to minimize freezing of the tanker and unloading apparatus. Also, at the unloading end, it has been contemplated to utilize above ground storage tanks. However, the gas must typically be compressed into the above ground tank. Thus, the capital expenditures and operating costs can be significant, making this an uneconomical alternative.

Figure 2:
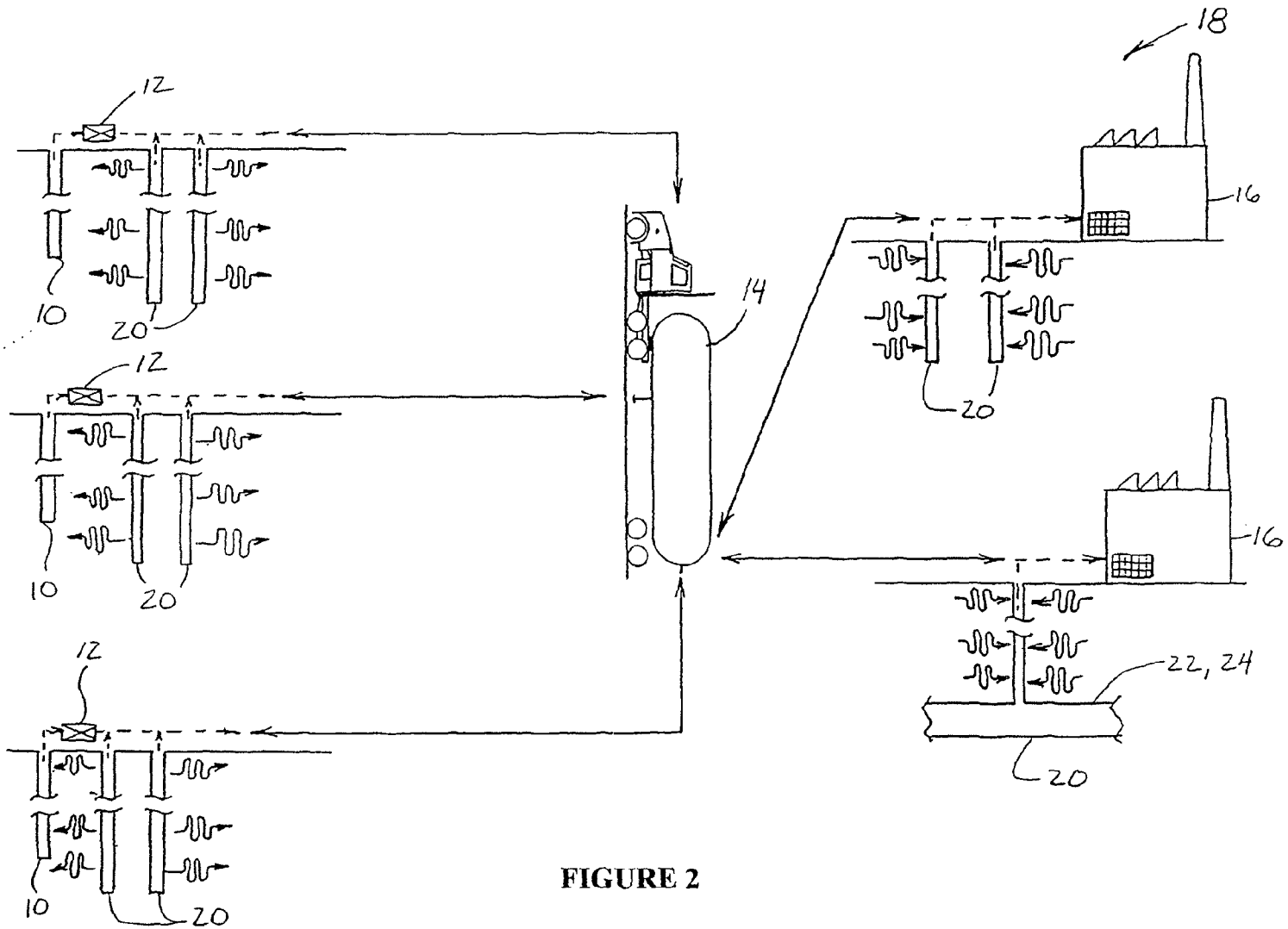
FIG. 2 is a simplified schematic diagram of a method and apparatus of the invention for recovering and transporting methane gas.

Referring now to FIG. 2, elements of a system, method and apparatus 18 of the present invention for recovering and transporting methane gas from a source, e.g., a producing well, such as one or more gas wells 10, to and end user, such as, but not limited to, co-firing power plant 16, is shown. Apparatus 18 of the system of the invention preferably includes at least one, and more preferably two or more, subterranean capacitors 20, in the vicinity of each gas well 10, into which methane gas from a producing well 10 can be compressed, by a compressor, such as compressor 12 shown, or other suitable apparatus. Each capacitor 20 can be a non-producing oil well, a producing oil well (FIG. 3), or a newly-constructed subterranean cylinder, having a capability of receiving and holding compressed methane gas, at a suitable pressurization, such as the 3000 psi pressure typically used in transport tankers, such as tanker 14.

Some oil wells have been found to have the capacity to hold gas pressurized to up to 4000 psi without significant leakage. A typical oil well (or subterranean cylinder) which is suitable for use as a capacitor 20, will be several hundred feet deep, and, more preferably, will be several thousand feet deep, for instance, 3000 feet deep, which is a common depth of oil wells found in the vicinity of coal mines in the Southern Illinois and Western Kentucky regions of the USA, where methane is typically found in extractable quantities in coal mines and is presently extracted using gas wells, such as the wells 10. A suitable oil well (or subterranean cylinder) utilizable as a capacitor 20 of the invention will be of a diameter of several inches, for instance, 4 to 10 inches, and commonly 8 inches in diameter, and will be encased in a steel casing. An oil well (or subterranean cylinder) utilized as a capacitor 20 may also include a smaller diameter production tube extending downwardly therethrough. The oil well (or subterranean cylinder) will also typically be encased in cement or concrete. As noted above, oil wells such as this are commonly found in the vicinity of gas bearing coal mines, and are often considered to be a liability to the owners of the oil wells, as they can cost several thousand dollars to plug. Thus, the owners of such oil wells are often eager and willing to allow alternate usage of them.

It has been found that a 3000 foot deep oil well (or subterranean cylinder) having an 8 inch diameter casing can receive and hold 300 mcf of methane gas at a pressurization of 3000 psi. Thus, two capacitors 20 in the vicinity of a producing gas well 10 can be expected to be capable of holding 600 mcf of methane gas, which would equal the capacity of two tankers 14. As a particular advantage of using at least one, and preferably two or more, capacitors 20 for receiving and holding gas extracted from a gas well 10, no transport tanker 14 or above ground storage tank is required to be present, and the compressing of the gas into the one or more capacitors can be performed on a continuous, or 24 hour a day, basis. It has been found that a smaller compressor 12 can be used, compared to that which is typically used for compressing gas into a transport tanker 14.

Additionally, the earth surrounding and in intimate contact with each of the capacitors 20 will have a normalized temperature which is equal to the average temperature in that region, for instance, in the mid-50° range, as is common in the Southern Illinois and Western Kentucky region. As a result, it has been found that the surrounding earth will serve as an excellent heat insulator for holding heat in the compressed gas, such that the gas will lose heat only slowly, and thus, will remain at an elevated temperature. And, because the gas is not being compressed into a tank, overheating is not as great a concern. Heat dissipation into the surrounding earth is represented in the Figures by the wavy arrows emanating from each of the capacitors 20. This represents the slowed heat transfer resulting from the insulating effect of the surrounding earth.

Still further, as a particular advantage, when a tanker is connected to one or more capacitors 20, it has been found that loading can be achieved quickly, because little or no compression of the gas being drawn from the capacitor or capacitors 20 is required, as the gas in the capacitor or capacitors 20 is already compressed to, or close to, the desired pressurization of 3000 psi.

It has further been found that 2 capacitors 20 such as described above, holding 600 mcf of methane gas can be loaded relatively quickly, for example, in one half hour or less. One reason for this is that the temperature drop experienced as a result of transfer to the initially lower pressure environment of the tanker, will be from the elevated temperature of the capacitor, not an ambient air temperature or the like, such that the end temperature will not be as close to the freezing temperature of the gas.

One or more capacitors 20 according to the present invention can also be advantageously utilized at the end user or other unloading site. Such capacitors 20, can be one or more of any of several different forms. For instance, a capacitor 20 could be an existing well, such as a producing or nonproducing oil well, as explained above. A capacitor 20 could also include an abandoned or unused coal mine 22, or an underground formation of rock 24, such as sand rock or the like. Still further, a capacitor 20 could also include a subterranean cylinder that is constructed near the producing well 10 for the sole purpose of receiving and storing gas in the cylinder, as described herein, or a newly-constructed subterranean cylinder that is located near automobiles (for the purpose of loading automobiles with gas). Prior to connection of a loaded tanker (such as tanker 14) to a capacitor or capacitors 20 at the unloading or end-user site, the capacitor or capacitors 20 can be preloaded with pressurized gas.

This can provide several advantages, including, but not limited to, the ability to unload into an already pressurized environment, such that the gas being unloaded is not and greatly chilled as would occur if unloaded into a much lower pressure environment. The gas holding capacity of the capacitors 20, particularly, a large formation of sand rock or the like, or a coal mine, can be quite large, for instance, larger than the capacity of a single tanker. As a result, when the gas is withdrawn from the capacitors 20, the remaining pressurized gas in the capacitors 20 can provide adequate pressure for the unloading of the gas. Thus, the gas in the formation can act as, or provide, a cushion in the gas holding system which will facilitate absorption of the gas into the system, and then drive the gas being unloaded from the system. Still further, by unloading the gas from a tanker into an already pressurized capacitor or capacitors 20, less depressurization occurs, resulting in less temperature drop in the gas. Once in the capacitor or capacitors 20, heat from the surrounding formation can be absorbed into the pressurized gas contained in the capacitor or capacitors 20, as illustrated by the wavy arrows, so as to raise the temperature thereof, such that there will be less occurrence of freezing of regulators and other apparatus as the gas is withdrawn therefrom. In the instance of a capacitor which is an oil well (or subterranean cylinder), it is preferred to use an oil well (or subterranean cylinder) having an internal casing diameter of several inches, for instance, 8 inches, and a depth of at least several hundred feet, and preferably several thousand feet, for instance, 3000 feet as commonly found in unused oil wells in the southern Illinois and Kentucky regions of the United States.

Still further, at the unloading end, when pressurized gas from a tanker 14 is unloaded into an already pressurized capacitor 20, little or an insignificant amount of the original pressurization from the loading process is lost, and, when the gas is withdrawn from the capacitor 20, it is typically desired to be at a substantially lower pressure, for instance, less than 100 psi, such that no compressor capability is required at that site. Cost of additional compressing of the gas at that location is also avoided. If it is desired or required to further pressurize gas introduced into a capacitor or capacitors 20 at the unloading site, when a compressor is used and the gas is resultantly heated, the surrounding formation can again serve as a heat sink for dissipating the extra heat, as explained above.

Figure 3:
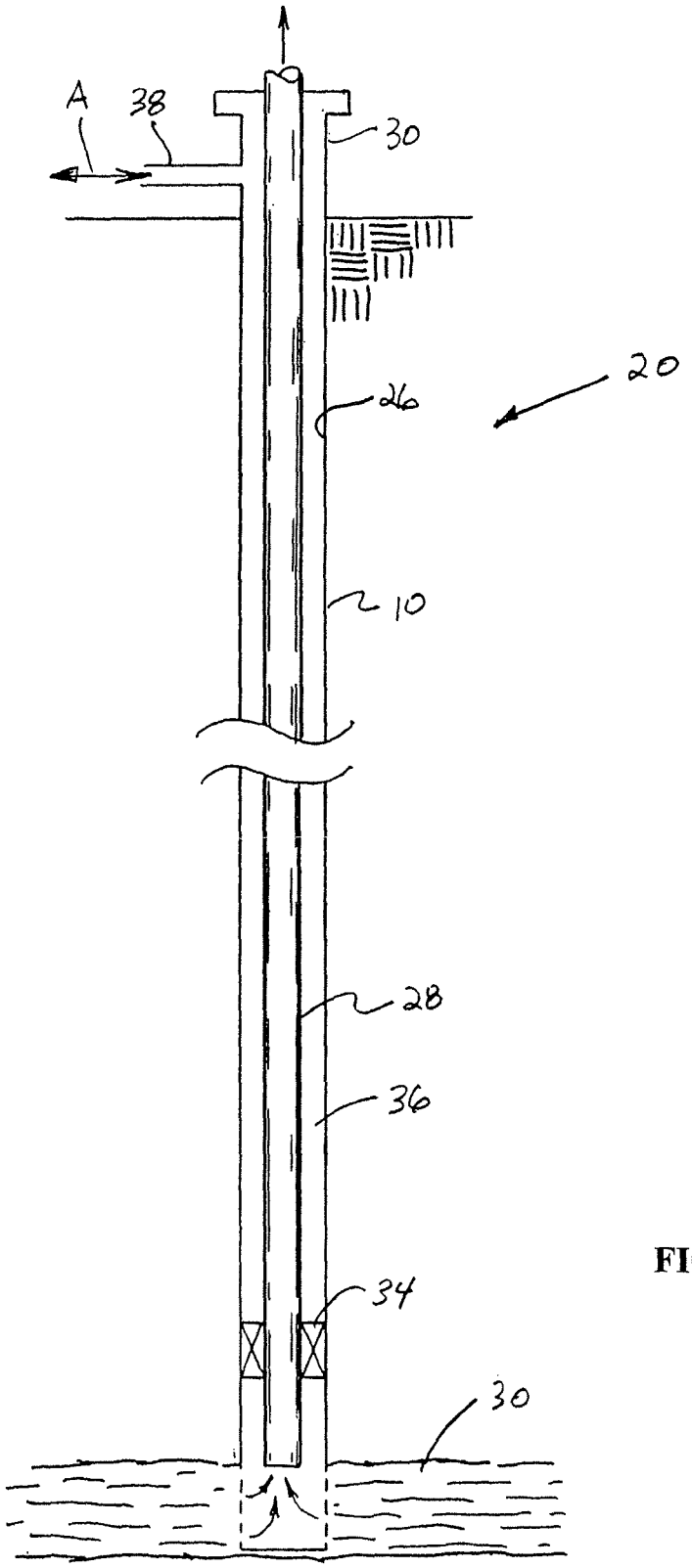
FIG. 3 is a simplified side view of an oil well adapted for use as a capacitor according to the invention.

Referring also to FIG. 3, a producing oil well 10, is illustrated, used as a capacitor 20 according to the teachings of the present invention. Well 10 includes a casing 26 which can be of several inches in diameter, for instance 8 inches, as is commonly used for casing wells in the southern Illinois and Kentucky regions. Well 10 can be several thousand feet deep, for instance 3000 feet deep, as is also common in those regions. A well 10 will often include a much smaller diameter tube 28, for instance of about 2 inches, extending therethrough which extends from the wellhead 32 and underlying gas or oil formation 32 for drawing gas or oil therefrom, as denoted by the arrows, for instance, using formation pressure and/or pumping. To facilitate use as a capacitor 20, a plug 34 can be inserted in the oil well 10 at a desired depth above the producing formation 30, for isolating an annular space 36 surrounding tube 28 above formation 30, from the formation 30, such that the space 36 can be used as the capacitor for receiving and holding compressed gas introduced into space 36 through a port 38, as denoted by arrow A. Port 38 can also be used for unloading capacitor 20, in the above described manner. As a result, it should be evident that either a producing or nonproducing well can be utilized as a capacitor 20 according to the present invention. Such wells have been found to have a pressure capacity of 4000 psi, which renders the wells suitable for use as a capacitor at a pressure of the desired 3000 psi.

The invention provides that oil fields, such as in the southern Illinois and Kentucky regions of the United States, commonly include wells drilled in a predetermined pattern, such as on 330 feet for 660 feet center-to-center spacings. Such distances are sufficiently small such that two or more of the wellheads can be economically connected together by high-pressure pipe. This is true both at the loading site and also the unloading site, such as an end user or the like.

According to still further embodiments of the invention, methods for delivering gas (preferably processed gas) to a tank of an automobile are provided, for the purpose of providing the automobile with a source of fuel for operation. Such methods generally comprise transferring gas from a producing well (or another source) to one or more subterranean capacitors as described herein, and storing the gas in the one or more subterranean capacitors. Preferably, the gas will be processed (as fuel for Natural Gas-compatible engines) following extraction from the producing well, and prior to storage in the subterranean capacitor. At this point, an automobile, including a car, truck, or other vehicle that comprises a methane- or Natural Gas-compatible engine, may be located in close proximity to the one or more subterranean capacitors. The gas may then be loaded and transferred into the gas tank of the automobile, from the one or more subterranean capacitors. Of course, in this embodiment, the "tank" is the container housed within, or otherwise connected to, the automobile from which gas is withdrawn for the purpose of providing combustible fuel to the engine of the automobile. The invention provides that such methods and systems allow a tank of the automobile to be loaded with gas at a rate of at least about 1 mcf per minute, to a final pressure of at least about 3000 psi.

Thus, there has been shown and described a novel method and apparatus for recovering, transporting, and loading methane gas into a tank, which overcomes many of the problems set forth above. It will be apparent, however, to those familiar in the art, that many changes, variations, modifications, and other uses and applications for the subject device are possible. All such changes, variations, modifications, and other uses and applications that do not depart from the spirit and scope of the invention are deemed to be covered by the invention which is limited only by the claims which follow.

What is claimed is:

1. A method for delivering gas to an automobile, which comprises the steps of:

(a) transferring gas from a producing well to a first subterranean capacitor and storing the gas in said capacitor;

(b) loading the gas from the first subterranean capacitor into a tanker at a rate that would be effective to load 300 mcf of gas to a pressure of at least about 3,000 psi in thirty minutes or less;

(c) transferring the gas from the tanker to a second subterranean capacitor; and (d) loading the gas from the second subterranean capacitor into a tank of the automobile at a rate of at least about 1 mcf per minute, to a final pressure of at least about 3000 psi, wherein the tank is a container housed within or connected to the automobile from which gas is withdrawn for providing combustible fuel to an engine of the automobile.

2. The method of claim 1, wherein one or more of the first and second subterranean capacitors are constructed from a formation selected from the group consisting of an oil well, coal mine, underground rock formation, and a subterranean cylinder.

3. The method of claim 2, wherein the gas is selected from the group consisting of methane gas, natural gas, combinations thereof, and constituents thereof.

4. The method of claim 3, wherein one or more of the first and second subterranean capacitors is a subterranean cylinder.

5. The method of claim 4, wherein the subterranean cylinder is installed for the purpose of storing gas therein.

6. The method of claim 5, wherein the subterranean cylinder has a diameter ranging between 4 and 10 inches.

7. The method of claim 5, wherein the subterranean cylinder is at least 300 feet in length.

8. The method of claim 5, wherein the subterranean cylinder is at least 3000 feet in length.

9. The method of claim 5, wherein the subterranean cylinder is capable of holding at least 300 mcf of methane gas at a pressurization of at least 3000 psi.

10. The method of claim 5, wherein gas is transferred from the producing well to the first subterranean capacitor via (i) a tanker, (ii) a pipeline, or (iii) any combination thereof.

11. A method for delivering gas to an automobile, which comprises the steps of:

(a) storing gas that is derived from a producing well in a first subterranean capacitor;

(b) loading the gas from the first subterranean capacitor into a tanker at a rate that would be effective to load 300 mcf of gas to a pressure of at least about 3,000 psi in thirty minutes or less;

(c) transferring the gas from the tanker to a second subterranean capacitor; and

[(d) loading the gas from the second subterranean capacitor into a tank of the automobile at a rate of at least about 1 mcf per minute, to a final pressure of at least about 3000 psi, wherein the tank is a container housed within or connected to the automobile from which gas is withdrawn for the purpose of providing combustible fuel to an engine of the automobile.

12. The method of claim 11, wherein one or more of the first and second subterranean capacitors are constructed from a formation selected from the group consisting of an oil well, coal mine, underground rock formation, and a subterranean cylinder.

13. The method of claim 12, wherein the gas is selected from the group consisting of methane gas, natural gas, combinations thereof, and constituents thereof.

14. The method of claim 13, wherein one or more of the first and second subterranean capacitors is a subterranean cylinder.

15. The method of claim 14, wherein the subterranean cylinder is installed for the purpose of storing gas therein.

16. The method of claim 15, wherein the subterranean cylinder has a diameter ranging between 4 and 10 inches.

17. The method of claim 15, wherein the subterranean cylinder is at least 300 feet in length.

18. The method of claim 15, wherein the subterranean cylinder is at least 3000 feet in length.

19. The method of claim 15, wherein the subterranean cylinder is capable of holding at least 300 mcf of methane gas at a pressurization of at least 3000 psi.

20. The method of claim 15, wherein gas is transferred from the producing well to the first subterranean capacitor via (i) a tanker, (ii) a pipeline, or (iii) any combination thereof.

* * * * *